US009914038B2

(12) United States Patent
Esayian et al.

(10) Patent No.: US 9,914,038 B2
(45) Date of Patent: Mar. 13, 2018

(54) SYSTEMS AND METHODS FOR GOLF BALL SELECTION

(75) Inventors: Gary M. Esayian, New York, NY (US); James S. Campbell, Great Falls, VA (US); Mitchell C. Voges, Simi Valley, CA (US); Gary N. Mayes, Madison, AL (US)

(73) Assignee: GBT TECHNOLOGIES LLC, Great Falls, VA (US)

( * ) Notice: Subject to any disclaimer, the term of this patent is extended or adjusted under 35 U.S.C. 154(b) by 273 days.

(21) Appl. No.: 12/492,116

(22) Filed: Jun. 25, 2009

(65) Prior Publication Data

US 2009/0325721 A1 Dec. 31, 2009

Related U.S. Application Data

(60) Provisional application No. 61/075,334, filed on Jun. 25, 2008.

(51) Int. Cl.

| | |
|---|---|
| ***A63B 69/36*** | (2006.01) |
| ***A63B 47/00*** | (2006.01) |
| *A63B 71/06* | (2006.01) |

(52) U.S. Cl.

CPC ..... *A63B 69/3658* (2013.01); *A63B 69/3623* (2013.01); *A63B 47/00* (2013.01); *A63B 47/008* (2013.01); *A63B 69/36* (2013.01); *A63B 71/0605* (2013.01); *A63B 2069/3602* (2013.01); *A63B 2069/3605* (2013.01)

(58) Field of Classification Search

CPC . A63B 69/36; A63B 69/3658; A63B 69/3623; A63B 2069/3605; A63B 2069/3602; A63B 47/008; A63B 59/0074

USPC ..... 473/221, 351

See application file for complete search history.

(56) References Cited

U.S. PATENT DOCUMENTS

| | | | | | |
|---|---|---|---|---|---|
| 4,063,259 | A | * | 12/1977 | Lynch et al. | 396/335 |
| 4,375,887 | A | * | 3/1983 | Lynch et al. | 473/409 |
| 5,209,485 | A | * | 5/1993 | Nesbitt et al. | 473/372 |
| 5,695,413 | A | * | 12/1997 | Yamagishi et al. | 473/374 |
| 5,823,878 | A | * | 10/1998 | Welch | 463/43 |

(Continued)

OTHER PUBLICATIONS

Golfdom Magazine, Jun. 1961, 9 pages total.*

(Continued)

*Primary Examiner* — William H McCulloch, Jr.
(74) *Attorney, Agent, or Firm* — Procopio, Cory, Hargreaves & Savitch LLP.

(57) ABSTRACT

A system for selecting a golf ball comprises a ballistics data input configured to receive ballistics data for a plurality of golf balls and for a plurality of launch conditions; a material data input configured to receive material measurement data for each of the plurality of golf balls; a data structure generation module configured to generate a data structure for each of the plurality of golf balls based on the ballistics data and measurement data; an indexing module configured to index the data structures relative to each other; a interactive feedback module configured to solicit and receive launch monitor data and preferences; a modeling module configured to generate a performance model based on the launch monitor data and preferences; and a selection module configured to select one of the plurality of golf balls based on the index and the performance model.

12 Claims, 2 Drawing Sheets

(56) References Cited

U.S. PATENT DOCUMENTS 5,833,553 A * 11/1998 Sullivan et al. ..... 473/374
5,911,636 A * 6/1999 Schmoll ..... 473/266
6,224,493 B1 * 5/2001 Lee et al. ..... 473/223
6,241,622 B1 * 6/2001 Gobush et al. ..... 473/199
6,398,670 B1 * 6/2002 Engelhardt et al. ..... 473/407
6,431,990 B1 * 8/2002 Manwaring ..... 473/199
6,561,925 B2 * 5/2003 Watanabe et al. ..... 473/371
6,658,371 B2 * 12/2003 Boehm et al. ..... 702/182
6,672,978 B1 * 1/2004 Morgan et al. ..... 473/407
6,760,685 B2 * 7/2004 Boehm ..... 702/182
7,059,976 B2 * 6/2006 Hayashi et al. ..... 473/377
7,159,451 B2 * 1/2007 McGann et al. ..... 73/65.03
7,166,035 B2 * 1/2007 Voges et al. ..... 473/222
7,276,560 B2 * 10/2007 Nanba et al. ..... 525/261
RE40,118 E * 2/2008 Watanabe et al. ..... 473/371
7,621,828 B2 * 11/2009 Voges et al. ..... 473/409
7,686,701 B2 * 3/2010 Hasegawa ..... 473/221
7,762,911 B2 * 7/2010 Gobush et al. ..... 473/409
7,892,114 B2 * 2/2011 Saegusa et al. ..... 473/409
7,908,907 B1 * 3/2011 Nelson et al. ..... 73/65.03
7,918,751 B1 * 4/2011 Mayes ..... 473/409
7,967,695 B2 * 6/2011 Voges et al. ..... 473/222
7,972,221 B2 * 7/2011 Furze et al. ..... 473/151
8,696,497 B2 * 4/2014 Voges et al. ..... 473/409
8,827,842 B2 * 9/2014 Voges et al. ..... 473/409
8,894,505 B2 * 11/2014 Johnson et al. ..... 473/289
8,935,103 B2 * 1/2015 Ishii ..... 702/33
8,950,236 B2 * 2/2015 Ishii et al. ..... 73/12.02
9,737,757 B1 * 8/2017 Kiraly ..... A63B 24/0021
2001/0016522 A1 * 8/2001 Watanabe et al. ..... 473/371
2001/0019972 A1 * 9/2001 Nesbitt ..... A63B 37/0003 473/372
2002/0077189 A1 * 6/2002 Tuer et al. ..... 473/151
2002/0156598 A1 * 10/2002 Boehm ..... 702/182
2002/0173372 A1 * 11/2002 Kluck et al. ..... 473/316
2003/0008731 A1 * 1/2003 Anderson et al. ..... 473/407
2003/0056567 A1 * 3/2003 Bissonnette et al. ..... 73/12.01
2003/0115011 A1 * 6/2003 Boehm ..... 702/127
2003/0176988 A1 * 9/2003 Boehm et al. ..... 702/182
2003/0209053 A1 * 11/2003 McNamara et al. ..... 73/12.01
2004/0006442 A1 * 1/2004 Boehm ..... 702/145
2004/0030527 A1 * 2/2004 Rankin ..... 702/153
2004/0142768 A1 * 7/2004 Yokota ..... A63B 37/0003 473/371
2005/0034506 A1 * 2/2005 Bissonnette et al. ..... 73/12.01
2005/0079932 A1 * 4/2005 Voges et al. ..... 473/407
2005/0085309 A1 * 4/2005 McGann et al. ..... 473/151
2005/0085311 A1 * 4/2005 Voges et al. ..... 473/221
2005/0199054 A1 * 9/2005 Spampinato et al. ..... 73/170.01
2006/0008116 A1 * 1/2006 Kiraly ..... G06T 7/20 382/103
2006/0046871 A1 * 3/2006 Ohama ..... A63B 37/0003 473/371
2006/0063613 A1 * 3/2006 Hayashi et al. ..... 473/378
2006/0128900 A1 * 6/2006 Nanba et al. ..... 525/261
2006/0189414 A1 * 8/2006 Voges et al. ..... 473/407
2007/0060321 A1 * 3/2007 Vasquez et al. ..... 463/27
2007/0167249 A1 * 7/2007 Voges et al. ..... 473/222
2007/0191088 A1 * 8/2007 Breckner et al. ..... 463/20
2008/0021651 A1 * 1/2008 Seeley ..... A63B 24/0021 702/3
2008/0051212 A1 * 2/2008 Voges ..... 473/331
2008/0287207 A1 * 11/2008 Manwaring ..... 473/199
2009/0017945 A1 * 1/2009 Tayama et al. ..... 473/409
2009/0197706 A1 * 8/2009 Yamada ..... A63B 37/0003 473/378
2009/0264222 A1 * 10/2009 Tarao ..... A63B 37/0003 473/378
2009/0318246 A1 * 12/2009 Shiga ..... A63B 37/0023 473/378
2009/0325721 A1 * 12/2009 Esayian et al. ..... 473/131
2011/0014997 A1 * 1/2011 Sullivan ..... A63B 37/0003 473/373
2011/0081986 A1 * 4/2011 Stites ..... 473/334
2011/0159990 A1 * 6/2011 Shiga ..... A63B 37/0003 473/371
2011/0319199 A1 * 12/2011 Voges et al. ..... 473/409
2012/0016599 A1 * 1/2012 Ishii ..... 702/33
2012/0202610 A1 * 8/2012 Voges et al. ..... 473/199
2013/0213153 A1 * 8/2013 Ishii et al. ..... 73/865.8
2013/0260914 A1 * 10/2013 Ishii ..... G06Q 10/0639 473/351
2013/0260922 A1 * 10/2013 Yontz et al. ..... 473/409
2014/0200091 A1 * 7/2014 Swartz et al. ..... 473/221
2014/0378238 A1 * 12/2014 Voges et al. ..... 473/198
2017/0106237 A1 * 4/2017 Dugan ..... A63B 24/0006
2017/0151462 A1 * 6/2017 Voges ..... A63B 24/0006
2017/0151473 A1 * 6/2017 Voges ..... A63B 53/0466
2017/0239522 A1 * 8/2017 Voges ..... A63B 24/0021

OTHER PUBLICATIONS

"Golf Ball FAQs," GolfBallSelector.com, Copyright 2013, accessed May 15, 2014, 3 pages, <http://golfballselector.com/golf/generic!viewFaqs.action>.*

"Technical Description of the Pendulum Test," The Royal and Ancient Golf Club of St Andrews and United States Golf Association, revised edition, Nov. 2003, 38 pages.*

* cited by examiner

SYSTEMS AND METHODS FOR GOLF BALL SELECTION

RELATED APPLICATIONS INFORMATION

The application claims priority under 35 U.S.C. 119(e) to U.S. Provisional Patent Application Ser. No. 61/075,334, filed Jun. 25, 2008, and entitled "System for Interactively Determining the Optimal Golf Ball for a Golfer," which is incorporated herein by reference in its entirety.

BACKGROUND

1. Technical Field

The embodiments described herein generally relate to automated fitting techniques for golf equipment, and more particularly to an automated technique for selecting a golf ball.

2. Related Art

The golf ball industry has seen tremendous growth and technological advances in the manufacturing of golf balls since 1999. The introduction and adaptation of multiple piece solid core golf balls to the various world professional golf tours at that time has driven manufacturers to explore the limits of golf ball construction and performance. While these developments have seen much advancement, the industry has seen little advancement in the approach to optimally fitting a golfer with the correct golf ball for their game. The golf ball manufacturers each provide golfers with systems that recommend golf balls within their brand but none of these systems address the entire golf ball selection across brands and in an independent manner which unifies a golfer's playing characteristics and preferences with specific performance characteristics of golf balls.

SUMMARY

A system that correlates ballistics and material measurement data against a golfer profile in order to select a golf ball is disclosed herein.

According to one aspect, a system for selecting a golf ball comprises a ballistics data input configured to receive ballistics data for a plurality of golf balls and for a plurality of launch conditions; a material data input configured to receive material measurement data for each of the plurality of golf balls; a data structure generation module configured to generate a data structure for each of the plurality of golf balls based on the ballistics data and measurement data; an indexing module configured to index the data structures relative to each other; a interactive feedback module configured to solicit and receive launch monitor data and preferences; a modeling module configured to generate a performance model based on the launch monitor data and preferences; and a selection module configured to select one of the plurality of golf balls based on the index and the performance model.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

The embodiments described herein allow the interactive determination of an optimal golf ball for a golfer; improving the golfer's experience and allocation of money for value in purchasing the balls and in validating manufacturer claims of performance and moving towards better standards for measurement of such performance claims. The embodiments described below allow for the creation of a golfer a unique profile through a series of interactive questions regarding their playing characteristics and preferences. The system matches this profile to a golf ball data model comprising of distance, spin, compression, cover hardness, hotness, and acoustics predictions of all golf balls available. The system identifies and recommends a set of golf balls that best fits the golfer's profile thus identifying the optimal golf ball(s) for the golfer. The golfer is then presented with value-for-money comparisons and options for obtaining the set of optimal golf balls in an economical manner. Additionally, the system can be adjusted to only present golf balls that are available within a retailer's existing inventory.

Figure 1:
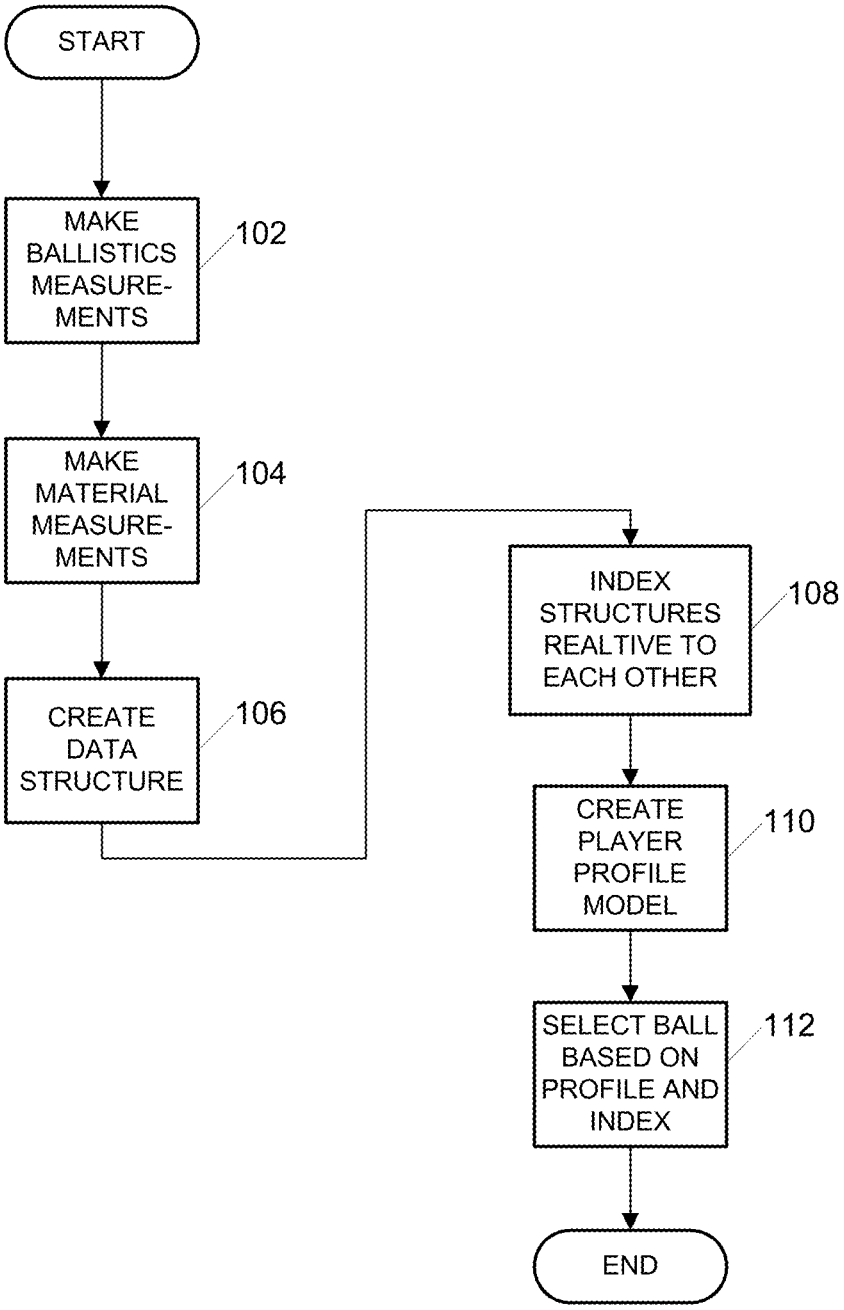
FIG. 1 is a flow chart illustrating an example process for selecting an optimized golf ball in accordance with one embodiment.

The embodiments described herein are based on the application of a standardized method of ballistics and materials performance measurements and evaluation techniques to index the relative performance of each registered ball in the system, to each and every other ball in the system, and then across multiple profiles of potential golfer types. FIG. 1 is a flow chart illustrating an example process for automatically selecting a golf ball in accordance with the one embodiment. In step 102, ballistic measurements are made for each ball registered with the system. The ballistics measurements are based on performance testing protocols that are standardized and consider a variety of differences in ball speed, launch angles, and spin rates. These testing methods also measure ball performance using a plurality of clubs, such as the driver, 6-iron, pitching wedge, and putter to create a true full game composition. Swing robots, can be used to generate the ballistics information. Robot swing speeds and profile/set-ups can be established to replicate the swings of senior/low ball speed golfers; average golfers; and tour caliber/high ball speed players.

Individual ball ballistics are measured on parameters of ball speed, launch angle and spin rate using, e.g., the Max Out Golf™ IGMS System, which is a camera-based launch monitor capture and reporting system using color-dot convention to best measure golf ball spin. The IGMS™ system allows the determination of optimal flight characteristics using internal ball flight optimization equations, including lift/drag parameters that influence aerodynamic flight characteristics of each ball, which are used to confirm the standard set-up conditions prior to testing.

In step 104, material measurements are made for each registered ball. Materials and golf ball construction parameters are evaluated on the dimensions of compression; cover hardness, and a relative "hotness" of a ball relative to other balls that influences the feel tendencies a golfer experiences when striking the golf ball.

The ballistics and material measurement data are then stored as a data structure in step 106. The data structures are then used to index each registered golf ball relative to the other registered golf balls in step 108. For example, a prediction model can be generated for each registered golf ball that considers each golf balls' relative performance with respect to each and every other ball in the system base don the data structures. Such a prediction model can consider any combination of feasible ball speed, launch angle, and spin rate a golfer may consider/generate using, e.g., the driver, 6-iron, or pitching wedge.

It will be understood that by measuring the ballistics and material data related to the golf ball construction and aerodynamic properties can also be captured. For example, information related to whether the ball is a 2, 3, or 4 piece design and information related to different types and uses of cover material can be captured.

In step 110, a plurality of golfer profiles are created and stored. Considering multiple profiles of potential golfer types is important for optimally fitting a single golf ball or set of like golf balls to a golfer, because the performance result a golfer achieves from any given golf ball depends on how well the ball performance characteristics are matched to that individual golfer's swing characteristics. These critical characteristics include the speed of the club head imparted on ball at impact; the specific golfer's angle of attack in striking the ball; the launch angle of the ball at impact; and the spin rate of the ball that all combine to affect distance; and control in a golf ball.

Golfer profiles are generated based on swing data for a golfer. In other words, an individual data model is generated for each golfer based on any combination of feasible ball speed, launch angle, and spin rate. This includes data models generated for the golfer using, e.g., the driver, 6-iron, pitching wedge, and putter. Statistical processing and optimization techniques, such as Ordinary Least Squares Regression (OLSQ), are used to generate one-stage and multi-stage prediction models for each of the golf clubs/conditions considered in the interactive profiling system for each golfer. These models are dynamically generated by inputs provided by the golfer, e.g., launch data information, or by proxies generated from questions asked of the golfer to approximate their ball flight and performance set-up. These models are also dynamically linked to each other and are used to generate golfer-specific data models that underlay the algorithmic fitting methodology.

For example, in certain embodiments, a golfer is queried on various ball flight characteristics to allow generation of performance proxies when actual launch monitor data is not available. The data prediction models also consider subtle differences in golfer swing style, such as angle of attack; and are designed to optimize the result based on environmental conditions, such as temperature.

In certain embodiments, an Analytical Hierarchal Processing (AHP) general methodology can be used to support the processing of interactive profiling questions in the system. Other multi-factor models can then be used to index and rank order performance in support of other elements of the processing. The AHP uses the results of a series of pair-wise comparisons to ascribe weights to the nodes on the AHP decision tree, with a result generated using matrix multiplication.

Further, algorithms within the AHP can consider the tradeoff of key performance factors the golfer might consider when evaluating a golf ball. These performance factors recognize tradeoffs, e.g., in distance, control, and feel that are important characteristics in choosing one golf ball over another. The algorithms also consider how feel and control might be considered depending on how close to the hole a golfer is; and how important a factor such as feel is given putting, chipping, or pitching. Algorithms also control and normalize for absolute measures of golf ball measures, such as compression or cover hardness.

The proprietary ballistics and materials measurement data is raw data that constitutes an array of possible performance outcomes for many combinations of golf ball and player profile. By collecting performance data on a cross-sectional basis of set up conditions (and with different club types), a gradation of performance across multiple factors or frontiers can be measured and estimated.

Since each data model is a unique performance gradient; and the aforementioned algorithms are unique and specific to the golfers profile and to the specific weightings applied during the interactive profiler; then each and every fitting session is unique and custom-tailored to each and every golfer using the system. The combination of these data models and weighting schema generate a rank-order result of golf balls in the system considering the preferences applied to the performance optimization by the golfer, and not determined by any outside expert system or fixed benchmark.

Further, in some embodiments, the system may present the golfer with a mixed golf ball trial set that identifies golf balls that most closely match the golfer's top recommendations for best fit in balls and packaged as a set of those best fit balls (of various brand and model types) in an assembled (economical) offering that allows further on-the-course player and practice testing and optimizations of the selection.

Figure 2:
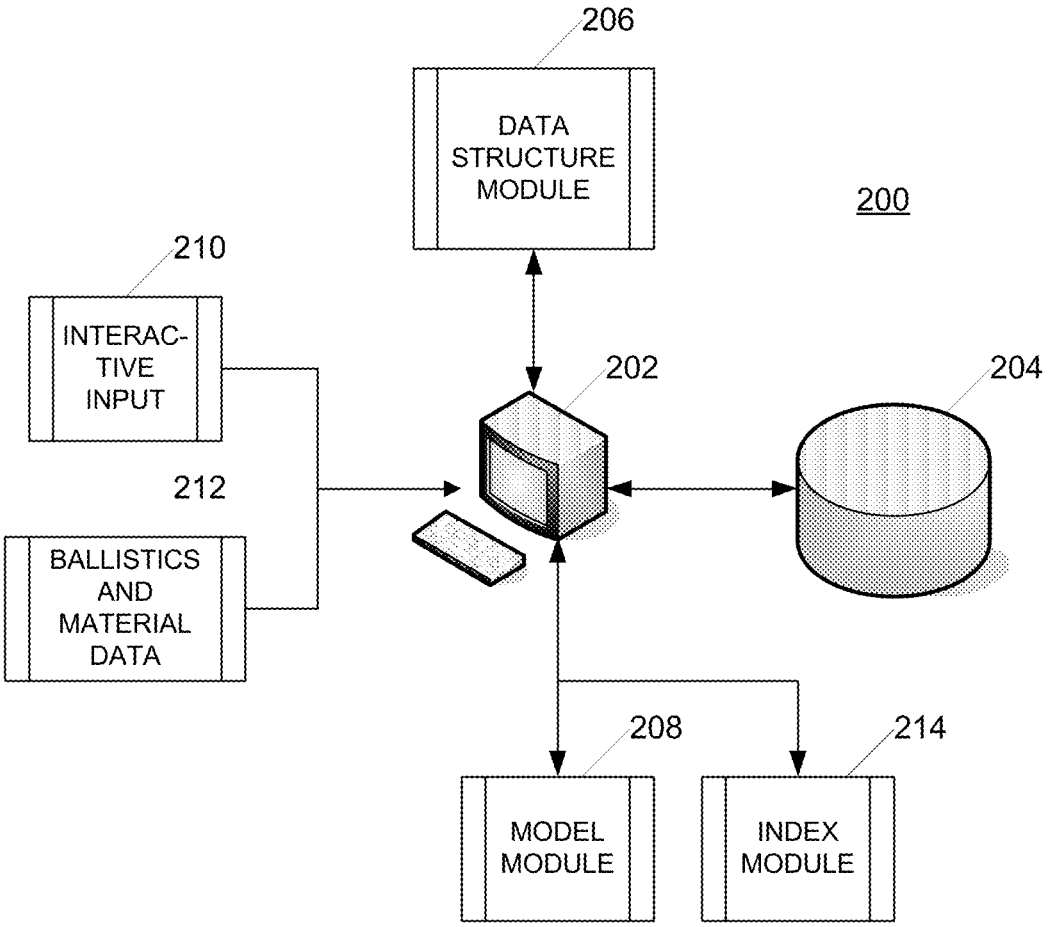
FIG. 2 is a diagram illustrating an example system for carrying out the process of FIG. 1.

FIG. 2 is a diagram illustrating an example system 200 configured to implement the process described above with respect to FIG. 1. System 200 comprises a profile authority 202 configured to create the data structures and models described above and to perform the indexing and golfer feedback routines necessary to generate the golfer specific selection of a golf ball. Thus, profile authority 202 can be configured to receive ballistics and material measurement data 212 for each registered golf ball in system 200. A data structure generation module can then cause profile authority 202 to generate the data structures for each golf ball and store them in database 204. Authority 202 can then index the golf balls relative to each other using the data structures and store the index information. Interactive feedback 210 can then be provided to authority 202, comprising launch data, proxy responses to interactive questions, preferences, tendencies, etc., or some combination thereof. An interactive profiling module can then cause profile authority 202 to generate the performance models that allows the selection of the optimum golf ball. These models can also be stored in database 204. For example, the models can then be used to rank the golf balls based on the indexing.

The term "authority" is intended to refer to the software and hardware required to perform the functions described herein. As such, the term authority can comprise one or more servers, routers, processors, API's, user interfaces, and software modules.

While certain embodiments have been described above, it will be understood that the embodiments described are by way of example only. Accordingly, the systems and methods described herein should not be limited based on the described embodiments. Rather, the systems and methods described herein should only be limited in light of the claims that follow when taken in conjunction with the above description and accompanying drawings.

What is claimed is:

1. A system for selecting a golf ball, comprising a computing device comprising a memory and a processor executing software, the software comprising:

a profile authority software module configured to receive ballistics data from a launch monitor, the ballistics data being measured for a plurality of golf balls over a plurality of different launch conditions, the ballistics data comprising ball speed, launch angle and spin rate associated with each of the plurality of golf balls, the launch conditions comprising at least different club types and different swing characteristics corresponding to at least three different levels of golfer ability;

wherein the profile authority software module is configured to receive material measurement data each of the plurality of golf balls, the material measurement data comprising at least cover hardness and compression parameters;

a data structure generation software module configured to generate a data structure comprising an array of possible performance outcomes for a plurality of combinations of ballistics data and material measurement data associated with each of the plurality of golf balls based on the ballistics data and measurement data received by the profile authority software module;

an indexing software module configured to index the plurality of golf balls relative to each other based on the generated data structures;

an interactive input software module configured to solicit and receive measured launch monitor data from a launch monitor and golfer preferences indicative of an individual golfer's measured swing characteristics;

a modeling software module configured to generate a unique performance model specific to the individual golfer's swing characteristics based on the measured launch monitor data and golfer preferences, the generated performance model comprising a plurality of dynamically generated and linked, multi-stage prediction models each being specific to an individual golfer and each predictive of approximate flight when striking a ball with one of a plurality of golf clubs and performance characteristics generated based on measured swing characteristics of the individual golfer swinging each of the plurality of golf clubs collected from the measured launch monitor data;

a ranking software module configured to rank the plurality of golf balls based on the index and the performance model specific to the individual golfer's swing characteristics measured across the plurality of golf clubs; and a selection software module configured to select at least one of golf ball ranked in the top of the golf ball ranking from the plurality of golf balls and to provide identification of the selected golf ball to the individual golfer.

2. The system of claim 1, wherein the selection software module is configured to select a trial set of golf balls to test by a golfer from the golf balls in the top positions of the golf ball ranking and to present the golfer with options to obtain the trial set for testing.

3. The system of claim 1, wherein the material measurement data further comprises golf ball hotness and acoustics predictions.

4. The system of claim 1, wherein the ballistics data includes swing robot data using the different golf club types and replicating the swings of golfers at the three levels of golfer ability.

5. The system of claim 1, wherein the golfer preferences comprise individual golfer's swing characteristics including angle of attack in striking a ball, launch angle of the ball on impact, and ball spin rate.

6. The system of claim 5, wherein the golfer's swing characteristics are generated from launch monitor data for the golfer using different types of golf club and playing conditions.

7. The system of claim 5, wherein the golfer's swing characteristics are generated from interactive profiling questions.

8. The system of claim 1, wherein the interactive input software module is configured to solicit and receive club information indicative of the individual golfer's golf club specifications as part of the golfer preferences;

wherein the modeling software module is configured to generate the performance model specific to the individual user's swing characteristics and the received club information; and wherein the selection software module is configured to select at least one golf ball matched to the club information received.

9. A computer implemented method of interactively selecting a golf ball for a player, comprising:

measuring, with a launch monitor, ball performance ballistics data for a plurality of different golf balls using a plurality of different launch conditions, the different launch conditions comprising at least different player performance levels and different golf clubs, the ball performance ballistics data comprising at least ball speed, launch angle and spin rate;

collecting ball material data for the plurality of golf balls, the material data comprising at least compression and cover hardness;

generating a golf ball data model, by a computing device, for each of the plurality of golf balls, the golf ball data model comprising an array of possible performance outcomes for a plurality of combinations of ballistics data and material measurement data at different player performance levels based on the ballistics data and measurement data;

creating a unique golfer profile specific to an individual golfer based on the golfer's measured playing characteristics and preferences, the created golfer profile comprising a performance model including a plurality of dynamically generated and linked, multi-stage prediction models each being specific to an individual golfer and each predictive of approximate flight when striking a ball with one of a plurality of golf clubs and performance characteristics generated based on measured swing characteristics of the individual golfer swinging each of the plurality of golf clubs collected from the measured launch monitor data;

comparing the golfer profile, by the computing device, to the golf ball data models of the plurality of golf balls and identifying a set of golf balls which best fit the golfer profile specific to the individual golfer's swing characteristics measured across the plurality of golf clubs; and presenting, by the computing device, the golfer with options for obtaining a packaged set of the identified golf balls for practice testing by the golfer.

10. The method of claim 9, wherein the golf ball material data further comprises hotness and acoustics predictions.

11. The method of claim 9, wherein the golfer profile is created from at least a golfer's answers to a plurality of interactive questions regarding playing characteristics and preferences.

12. The method of claim 11, wherein the golfer profile further comprises launch monitor data of the golfer's swing characteristics.

* * * * *